US007207429B2

(12) United States Patent
Frabetti et al.

(10) Patent No.: US 7,207,429 B2
(45) Date of Patent: Apr. 24, 2007

(54) FEEDING DEVICE OF CHOCOLATES AND SIMILAR PRODUCTS

(75) Inventors: Fabio Frabetti, Bologna (IT); Luca Baraldi, Bologna (IT)

(73) Assignee: SACMI Packaging S.p.A., Imola (Bologna) (IT)

( * ) Notice: Subject to any disclaimer, the term of this patent is extended or adjusted under 35 U.S.C. 154(b) by 187 days.

(21) Appl. No.: 10/509,446

(22) PCT Filed: Apr. 2, 2003

(86) PCT No.: PCT/IB03/01205

§ 371 (c)(1),
(2), (4) Date: Dec. 1, 2004

(87) PCT Pub. No.: WO03/082677

PCT Pub. Date: Oct. 9, 2003

(65) Prior Publication Data

US 2005/0086913 A1 Apr. 28, 2005

(30) Foreign Application Priority Data

Apr. 3, 2002 (IT) ..... BO02A0175

(51) Int. Cl.
*B65B 35/16* (2006.01)

(52) U.S. Cl. ..... 198/461.1; 198/464.1; 198/470.1; 198/577; 198/689.1

(58) Field of Classification Search ..... 198/461.1, 198/464.1, 464.2, 470.1, 575, 576, 577, 579, 198/689.1

See application file for complete search history.

(56) References Cited

U.S. PATENT DOCUMENTS

| | | | | |
|---|---|---|---|---|
| 3,570,647 | A * | 3/1971 | Meikle et al. | 198/468.6 |
| 3,608,697 | A * | 9/1971 | Wahle et al. | 198/460.1 |
| 4,514,963 | A * | 5/1985 | Bruno | 53/493 |
| 4,653,630 | A * | 3/1987 | Bravin | 198/460.1 |
| 4,815,581 | A * | 3/1989 | Deutschlander | 198/461.3 |
| 4,921,398 | A * | 5/1990 | Fluck | 414/798.7 |
| 5,038,915 | A * | 8/1991 | Delsanto | 198/419.3 |
| 5,097,939 | A * | 3/1992 | Shanklin et al. | 198/419.2 |
| 5,341,915 | A * | 8/1994 | Cordia et al. | 198/460.1 |
| 5,752,369 | A * | 5/1998 | Suga | 53/511 |

(Continued)

*Primary Examiner*—Douglas A. Hess
(74) *Attorney, Agent, or Firm*—William J. Sapone; Coleman Sudol Sapone PC

(57) ABSTRACT

A feeding device of chocolates and similar products for a wrapping machine includes: a first belt means which has a continuous advance motion, supports and moves a plurality of products, aligned and arranged in a single line at mutual contact; a second belt means aligned downstream the first belt means, having an alternate advance motion and associated to holding means of the product; a positioning wheel rotating, facing the second belt means immediately downstream the holding means and having a plurality of angularly equidistant pliers means for gripping the product. The second belt means moves the products, reciprocally spaced, from a picking condition, in which the second belt means receives the product from the first belt means, through moving conditions, in which the holding means keep each product fixed to the second belt means, to a transfer condition, in which the second belt means is motionless and the product, not constrained thereto anymore, is grasped by a pliers means of the positioning wheel, which moves the product with a circular motion from the transfer condition to a release condition in which the wheel is motionless and the pliers means is opened for transferring the product to the wrapping machine.

17 Claims, 4 Drawing Sheets

U.S. PATENT DOCUMENTS 5,761,883 A * 6/1998 Pruett et al. ..... 53/448
5,881,860 A * 3/1999 Zecchi et al. ..... 198/464.4
5,971,134 A * 10/1999 Trefz et al. ..... 198/460.1
5,979,636 A * 11/1999 Vanacore et al. ..... 198/460.1
6,000,528 A * 12/1999 van Maanen ..... 198/461.1
6,131,372 A * 10/2000 Pruett ..... 53/448
6,446,789 B1 * 9/2002 Goodman ..... 198/689.1
6,690,995 B2 * 2/2004 Prutu ..... 700/228
7,083,374 B2 * 8/2006 Bennett ..... 414/798.2

* cited by examiner

FEEDING DEVICE OF CHOCOLATES AND SIMILAR PRODUCTS

TECHNICAL FIELD

The present invention relates to automatic packaging machines, and particularly the invention refers to a feeding device of chocolates or similar products with flat base for a wrapping machine.

BACKGROUND ART

It is known that in the wrapping machine for chocolates and similar products with traditional wrapping styles the wrapping material must move parallely to the product short side, which is moved along a direction parallel to the product long side for stability need. For this reason, usually the feeding devices, including one or more belts, are positioned perpendicularly to the product flow on the machine and, therefore, transversally with respect to the latter.

The main drawback of said devices consists in that their transversal position makes difficult the access to the maintenance points, positioned at opposite sides of said device, reducing the timeliness of the operator's intervention, particularly in case the operator must control several wrapping machines, parallely positioned in an automatic feeding line, forcing to have an operator for each machine.

There are known feeding devices which allow to feed the products with the long side parallel to the machine by means of one or more storage belt, from which the products are transferred, for instance by pushers, to a disk provided with housing slots, which rotates said products of 90°, in order to correctly orientate for picking or transferring them to the following machine working station.

The main drawback of said known device consists in the mechanical stresses, which the pushers, or the like, exert on the products, and in the unavoidable collisions thereof against the housing slot walls, during the 90° rotation working cycles. Said stresses can damage products, with possible fragment detachments that create unwanted dirt accumulation on the machine members.

Other drawback of the above described devices consists in that, for high production speeds, the products tend to slip on the storage belt, till they miss their correct positioning in the picking or transfer zone within the machine cycle, in such a way causing idle cycles with consequent reduction of machine production.

DISCLOSURE OF THE INVENTION

The main object of the present invention is to propose a feeding device, which can operate at high speeds, guaranteeing a regular and reliable operation, without blockages, jams, and product feeding idle cycle, maintaining a product feeding synchronized with the machine.

Other object of the present invention is to propose a device, which allows delicately handling and/or moving the product, avoiding breaks or damages thereof.

Further object is to propose a device, which is accurate and reliable and guarantees a perfect phase synchronization with the downstream wrapping machine.

The above-mentioned objects are achieved according to the content the claim content.

BRIEF DESCRIPTION OF THE DRAWINGS

The characteristics of the present invention are underlined in the following with particular reference to the attached drawings, in which.

BEST MODE OF CARRYING OUT THE INVENTION

Figure 1:
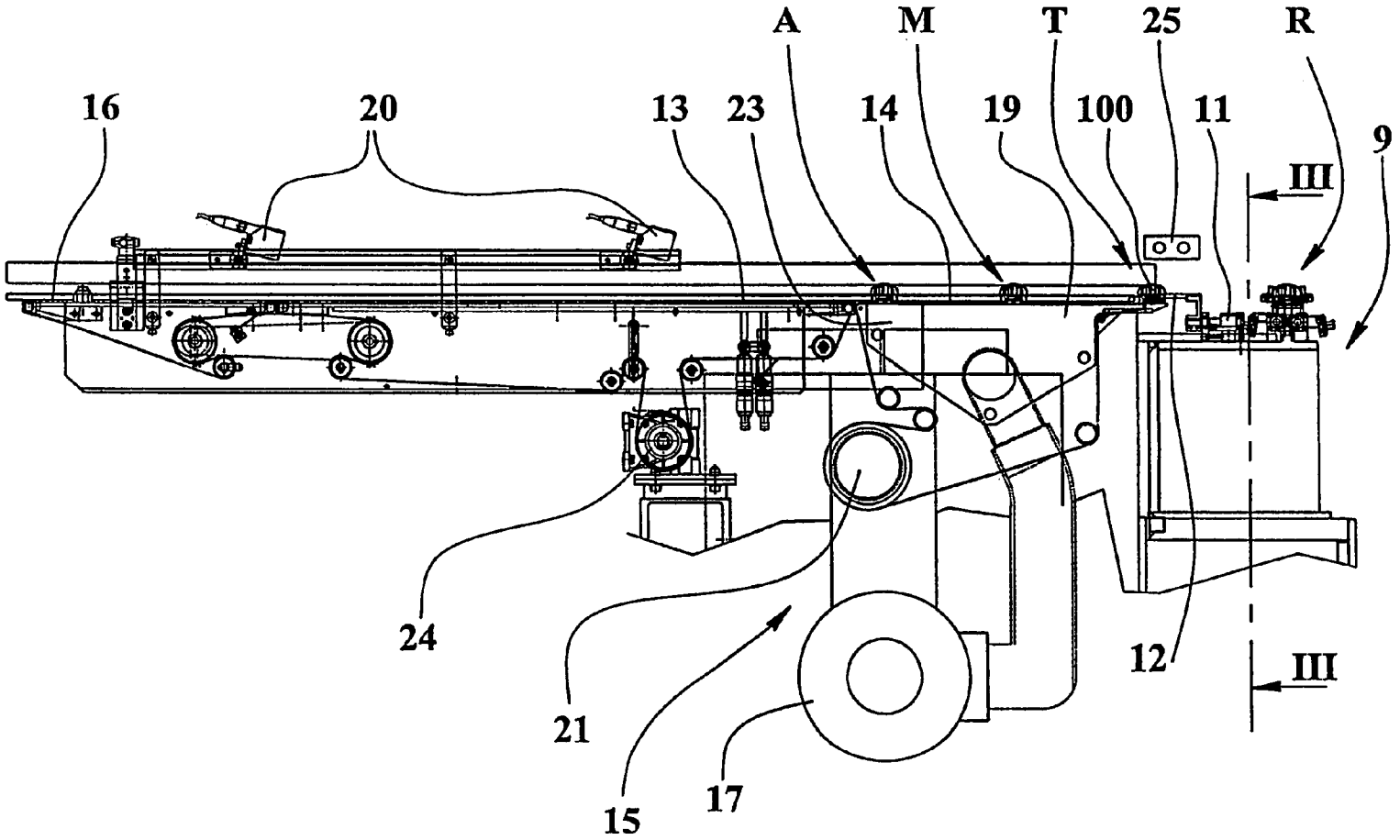
FIG. 1 show a partial section front view of the feeding device of the present invention.
Figure 2:
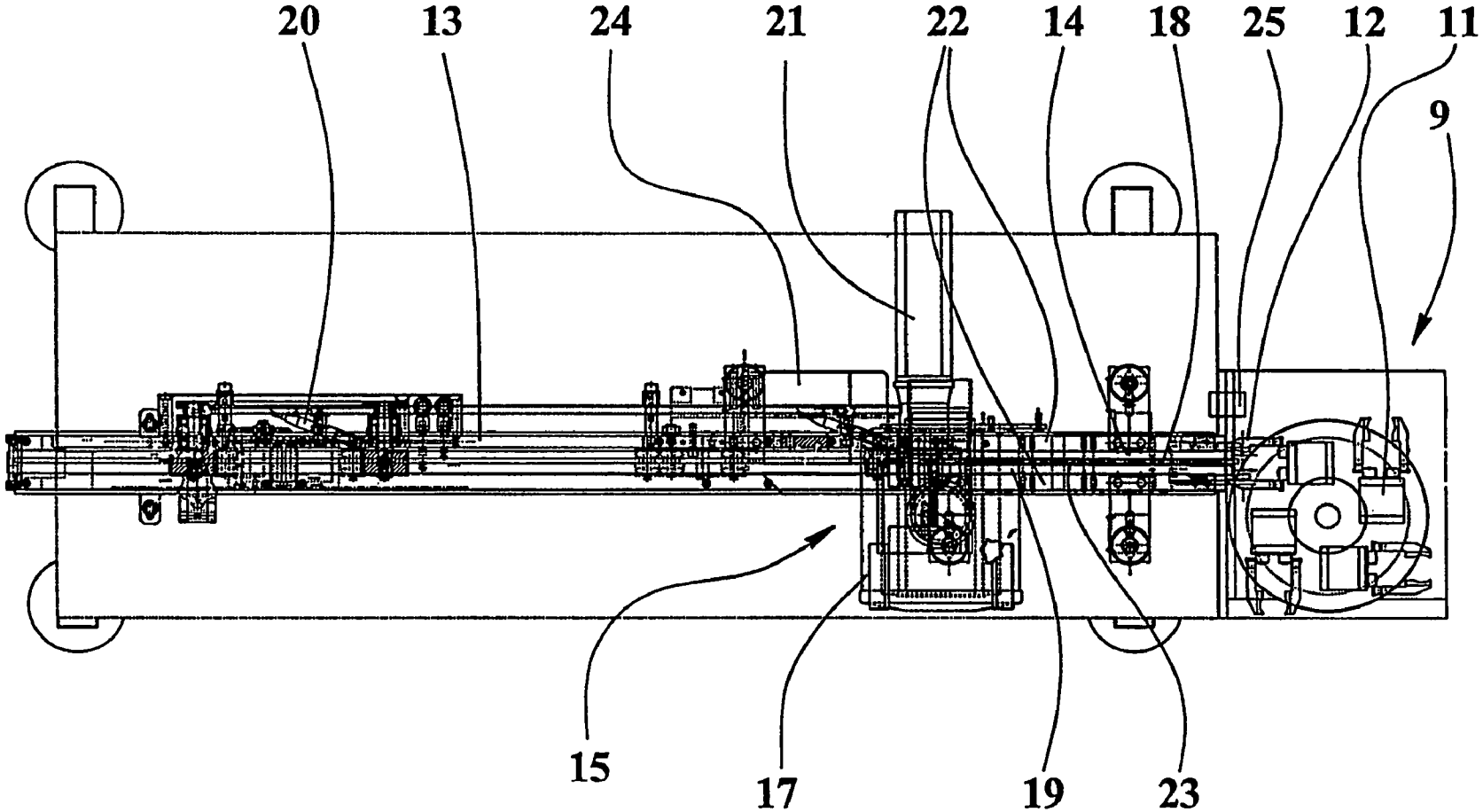
FIG. 2 shows a plan view of the FIG. 2 device.
Figure 3:
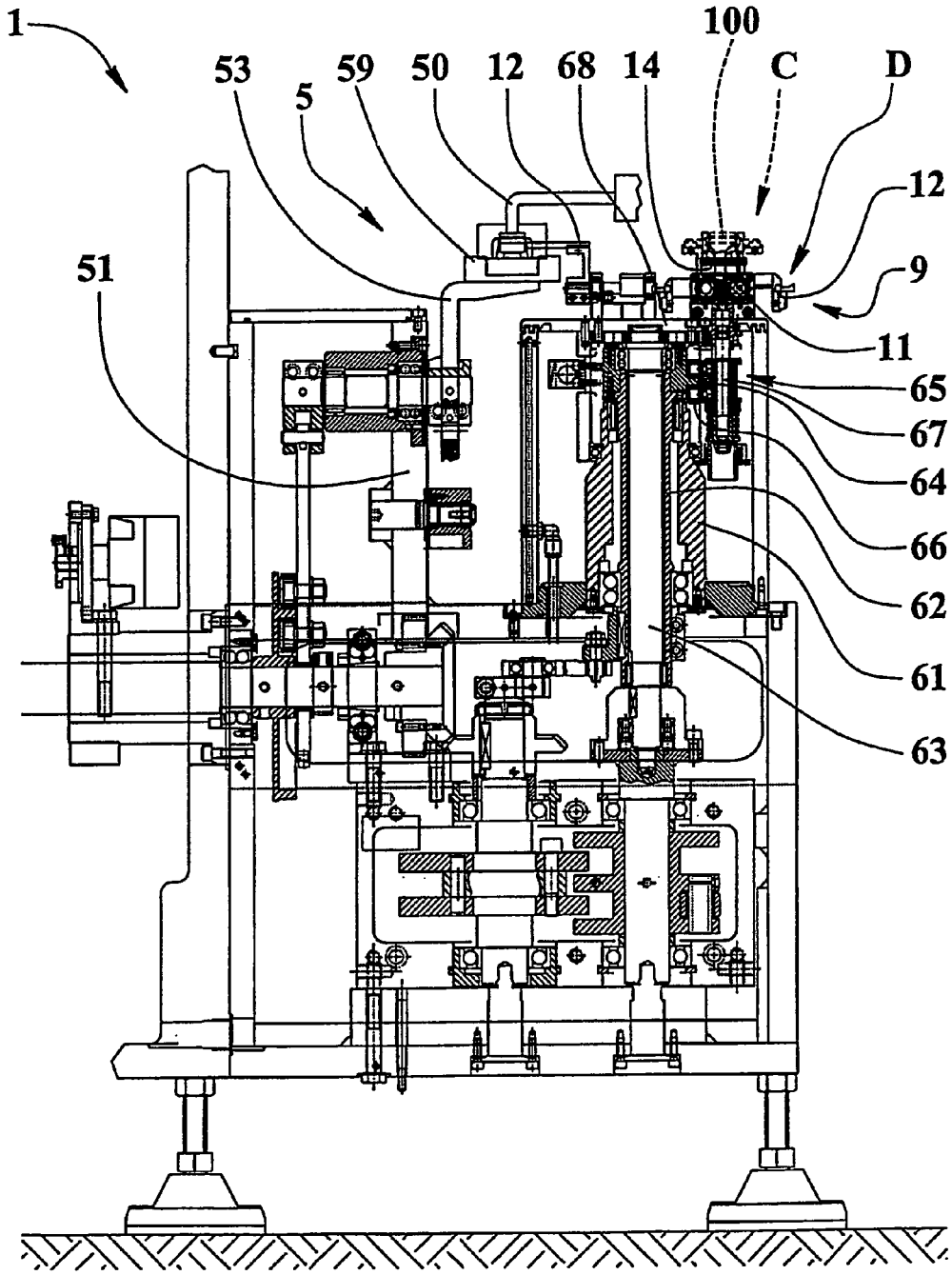
FIG. 3 shows a partial section view according to plain III—III of FIG. 1.
Figure 5:
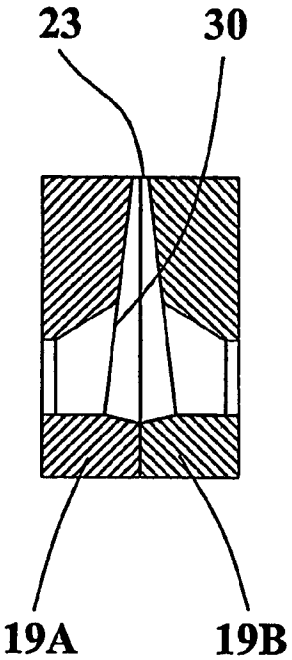
FIG. 5 shows a section view according to plain V—V of FIG. 4.
Figure 4:
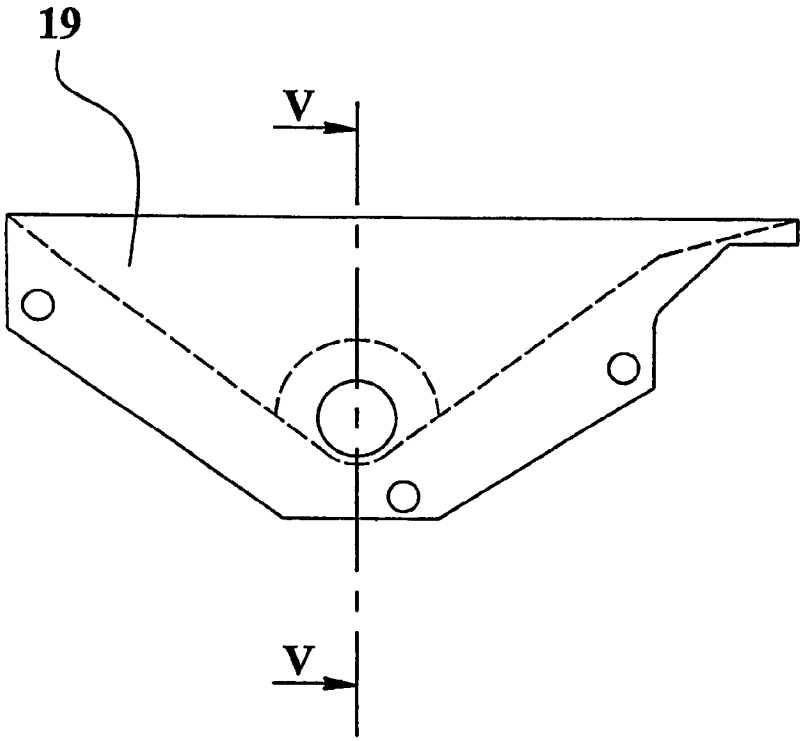
FIG. 4 shows a front view of conveyer means of the FIG. 1 device.

With reference to FIGS. 1 to 5, numeral 1 indicates the feeding device of product 100 substantially constituted by belt means first 13, second 14 and third 16 and by a positioning wheel 9.

The first means belt 13 has a continuous advance motion and supports and moves a plurality of products 100, aligned and arranged in a single line at mutual contact forming a storage queue. The second belt means 14, which is aligned downstream the first belt means 13, has an alternate advance motion, that is a periodical intermittent motion, and it is associated with holding means 15 of product 100, which operate on the portion of said second belt means 14 on which the products 100 are positioned.

The third belt means 16, is aligned upstream the first belt means 13 with respect to the first belt means 13 and has a continuous advance motion, with a translation speed greater than the speed of first belt means 13.

The holding means 15 are constituted essentially by an air suction means 17 connected through a duct means 19 to at least an opening 18, carried out in the second belt 14, in order to hold and to constrain through suction the products 100 to the second belt 14.

The suction means 17 consists of a vacuum pomp or a suction fan and the opening 18 may consist of a longitudinal slot, carried out by a couple of parallel and transversally spaced apart conveyor belts 22, which constitute the second belt 14. In alternative, the opening 18 may consist of a plurality of through holes carried out in the second belt means 14.

The duct means 19 is delta shaped and extends in a direction parallel to the second belt means 14 and is longitudinally divided in two specular portions 19A and 19B hermetically fixed each to the other, in such a way that the inner space is bounded by shaped surfaces which constitute a divergent duct which makes easier the quick evacuation of the air sucked by the suction means 17. Particularly, starting from a suction mouth 23, defined by the two portions 19A, 19B and at whose sides there are the conveyor belts 22, the cross section of duct means 19 internally widens with divergent side surfaces 30 up to connection conical portion of suction means 17.

The feeding group 10 includes two first sensor means 20 of minimum and maximum load, fit to sense the presence of products 100 on the first belt means 13 and in particular fit to measure respectively the minimum and maximum dimensions of the storage queue of products 100 on said belt, in order to balance the upstream product flow with wrapping machine speed.

There are furthermore second sensor means 25, positioned close to the portion of second belt means 14, which is adjacent to the positioning wheel 9, and fit to sense the presence and the correct position of product 100 and to define consequently operational phase between belt 14 and wheel 9.

The sensor means 20, 25 are of known type, such as inductive, capacitive or optical type, for instance photocells or optical fibers.

The second belt means 14 is rotatably powered by an electric motor 21 of brushless type, position, speed and acceleration controlled, in such a way to move according to predefined and programmable motion laws, while the belt means first 13 and third 16 are rotated by a ratio-motor 24.

The positioning wheel 9 rotates on a vertical axis and has four pliers means 11, angularly equally spaced apart, which grasp the product 100 from the second belt means 14. The pliers means 11 are positioned at 90° one with respect to the other and they are fixed to the wheel 9 with an orientation almost tangential to a geometric circumference inscribed in the positioning wheel 9.

The positioning wheel 9 is substantially constituted by a first column 61 of the device 1, rotatably supporting a second column 62 and a third column 63, coaxial thereto and independently rotating on a vertical axis.

Each pliers means 11 is fixed, through a support plate 68, to the third column 63 and includes a couple of mobile tines 12, symmetrically rotating between a closing condition C, in which said tines 12 are at their minimum distance for grasping a product 100, and an opening condition D, in which they are at the maximum distance for releasing said product 100.

The opening and the closing of mobile tines 12 of each pliers means 11 is made through transmission means 65, connected to control means 64 of the second column 62 and moved by these last control means 64, by virtue of the partial alternate rotation of said second column 62.

Each transmission means 65 is essentially constituted by a pivot 67, which is slidably supported by the third column 63 and connected to the mobile tines 12 of the respective pliers means 11 through a pinion-rack connection. Furthermore the pivot 67 is slidably engaged, through sliding rolls 66, to a cam profile of control means 64 fixed to the second column 62.

The swinging of cam profile, controlled by an eccentric movement, causes the rising or descending translation of pivots 67 and, consequently, respectively the opening or closing rotation of mobile tines 12 of pliers means 11.

The feeding device 1 is entirely controlled by calculation and control electronic means fit to control the phase relations among the belt means 13, 14, 16, the sensor means 20, 25, the positioning wheel s and the pliers means 11.

The operation of feeding group 10 provides that the belt means third 16 and first 13 move the products 100 with uniform and continuous rectilinear motion at the respective decreasing speeds to guarantee a storage queue of products 100, controlled by minimum and maximum load sensor means 20, sufficient to feed without discontinuity the following second belt means 14. The latter moves with an alternate motion law, having a stroke equal to the product length to be moved and with a speed varying from a minimum value equal to zero to a maximum value, which is function of the machine cycle.

The passage condition of product 100 from the belt means 13 to the belt means 14 is guaranteed in that the constant speed of the belt means 13 is higher than the average speed of belt means 14. The effect of different speeds is particularly evident at the beginning of the feed cycle of belt means 14, when the speed of said belt means 14 is zero in a single instant, in the picking condition A. The slow acceleration of the feed cycle of belt means 14 guarantees that the product 100 sticks to the belt means in such way that the suction effect allows positioning said product 100 without slipping.

The final deceleration allows the product 100 to be grasped, in a transfer position T, by pliers means 11 of the positioning wheel 9. The particular geometric position of the pliers means 11 on the positioning wheel 2, allows rotating product 100, grabbed by the pliers means 11 without interference with a coming following product.

In moving conditions M of second belt means 14, in which the products are moved thereby, the holding means 15 maintain each product 100 fixed to belt means 14, avoiding slipping phenomenon which could create between the products gaps, which can not filled anymore, or even collisions between the products.

The second belt means 14 is preferably moved with an alternate motion according to a motion law of asymmetrical cycloidal type, with symmetry ratio of 1,5. Such law has duration of the acceleration phase equal to ¾ of the whole cycle and a deceleration phase equal to ¼ of the cycle.

During the device 1 operation, the positioning wheel 9 takes the product 100 from the second belt means 14 and moves said product 100 with alternated circular motion from the transfer condition T to a release condition R, in which the wheel 9 is motionless and the related pliers means 11 holding the product 100 is opened for transferring the latter to the elevator group 5.

The main advantage of the present invention is to provide a feeding device, which can operate at high speeds, guaranteeing a regular and reliable operation, without blockages, jams and product feeding idle cycle.

Other advantage of the present invention is to provide a device, which allows delicately handling and/or moving the product, avoiding breaks or damages thereof.

Further advantage is to provide a device, which is accurate and reliable and guarantees a perfect phase synchronization with the downstream wrapping machine.

The invention claimed is:

1. Feeding device of chocolates and similar products (100) for a wrapping machine characterized in that said feeding device includes:

a first belt means (13), which has a continuous advance motion, supports and moves a plurality of products (100), aligned and arranged in a single line at mutual contact;

a second belt means (14), aligned downstream from the first belt means (13), having an alternate advance motion and associated with holding means (15) for the product (100);

a positioning wheel (9) rotating, facing the second belt means (14) immediately downstream of the holding means (15) and having angularly equidistant a plurality of pliers means (11) for gripping the product (100);

the second belt means (14) moves the products (100), reciprocally spaced, from a picking condition (A), in which the second belt means (14) receives the product (100) from the first belt means (13), through moving conditions (M), in which the holding means (15) keep each product (100) fixed to the second belt means (14), to a transfer condition (T), in which the second belt means (14) is motionless and the product (100), not constrained thereto anymore, is grasped by a pliers means (11) of the positioning wheel (9), which moves the product (100) with circular motion, from the transfer condition (T) to a release condition (R) in which the wheel (9) is motionless and the pliers means (11) is opened for transferring the product (100) to the wrapping machine, the feeding device having at least sensor means, first (20) and second (25), of optical or inductive or capacitive type, fit for sensing the presence of products (100) respectively in correspondence of the first belt means (13) and of the second belt means (14).

2. Device according to claim 1 characterized in that the feeding device includes a third belt means (16) aligned upstream the first belt means (13), having a continuous advance motion.

3. Device according to claim 2 characterized in that the first belt means (13) has a translation speed lower than the speed of third belt means (16) and higher than the average translation speed of second belt means (14).

4. Device according to claim 2 characterized in that the belt means, first (13) and third (16), are rotated by at least a respective ratio-motor (24).

5. Device according to claim 1 characterized in that the holding means (15) includes at least an air suction means (17) connected through duct means (19) to at least an opening (18) of second belt means (14), in order to hold by suction each product (100) supported by the second belt means (14).

6. Device according to claim 5 characterized in that the suction means (17) consists of a vacuum pump or a suction fan.

7. Device according to claim 5 characterized in that the opening (18) includes a plurality of through holes carried out on the second belt means (14).

8. Device according to claim 5 characterized in that the second belt means (14) consists of a couple of conveyor belts (22) parallel and transversally spaced apart by at least the opening (18), shaped as a slot.

9. Device according to claim 5 characterized in that the duct means (19) has an elongated shape and includes a suction mouth (23) in flow communication with at least the opening (18).

10. Device according to claim 9 characterized in that the duct means (19) include at least an inner duct having a divergent shape, starting from the suction mouth (23) up to the connection with the suction means (17).

11. Device according to claim 1 characterized in that the second belt means (14) is rotated by an electric motor (21) of brushless type, controlled in position, speed and acceleration.

12. Feeding device of chocolates and similar products (100) for a wrapping machine characterized in that said feeding device includes:

a first belt means (13), which has a continuous advance motion, supports and moves a plurality of products (100), aligned and arranged in a single line at mutual contact;

a second belt means (14), aligned downstream from the first belt means (13), having an alternate advance motion and associated with holding means (15) for the product (100);

a positioning wheel (9) rotating, facing the second belt means (14) immediately downstream of the holding means (15) and having angularly equidistant a plurality of pliers means (11) for gripping the product (100);

the second belt means (14) moves the products (100), reciprocally spaced, from a picking condition (A), in which the second belt means (14) receives the product (100) from the first belt means (13), through moving conditions (M), in which the holding means (15) keep each product (100) fixed to the second belt means (14), to a transfer condition (T), in which the second belt means (14) is motionless and the product (100), not constrained thereto anymore, is grasped by a pliers means (11) of the positioning wheel (9), which moves the product (100) with circular motion, from the transfer condition (T) to a release condition (R) in which the wheel (9) is motionless and the pliers means (11) is opened for transferring the product (100) to the wrapping machine, the positioning wheel (9) including at least four pliers means (11) mutually positioned at 90° and fixed to the wheel (9) with an orientation almost tangential to a circumference inscribed in the positioning wheel (9).

13. Feeding device of chocolates and similar products (100) for a wrapping machine characterized in that said feeding device includes:

a first belt means (13), which has a continuous advance motion, supports and moves a plurality of products (100), aligned and arranged in a single line at mutual contact;

a second belt means (14), aligned downstream from the first belt means (13), having an alternate advance motion and associated with holding means (15) for the product (100);

a positioning wheel (9) rotating, facing the second belt means (14) immediately downstream of the holding means (15) and having angularly equidistant a plurality of pliers means (11) for gripping the product (100);

the second belt means (14) moves the products (100), reciprocally spaced, from a picking condition (A), in which the second belt means (14) receives the product (100) from the first belt means (13), through moving conditions (M), in which the holding means (15) keep each product (100) fixed to the second belt means (14), to a transfer condition (T), in which the second belt means (14) is motionless and the product (100), not constrained thereto anymore, is grasped by a pliers means (11) of the positioning wheel (9), which moves the product (100) with circular motion, from the transfer condition (T) to a release condition (R) in which the wheel (9) is motionless and the pliers means (11) is opened for transferring the product (100) to the wrapping machine, the positioning wheel (9) including a first column (61) fixed to the device (1) and rotatably supporting a second column (62) and a third column (63), coaxial thereto and independently rotating on a vertical axis.

14. Device according to claims 12 and 13 characterized in that each pliers means (11) is fixed, through a support plate (68) and includes a couple of mobile tines (12), symmetrically rotating between a closing condition (C), in which said tines (12) are at the minimum mutual distance for gripping a product (100), to an opening condition (D), in which they are at a maximum mutual distance for releasing said product (100).

15. Device according to claim 14 characterized in that each pliers means (11) includes transmission means (65) connected to control means (64) of the second column (62), these last ones being fit to open and close the mobile tines (12) of each pliers means (11), through the rotation of said second column (62).

16. Device according to claim 15 characterized in that each transmission means (65) includes at least a pivot (67), slidably supported by said third column (63), connected to the mobile tines (12) of the respective pliers means (11)

through a pinion-rack connection, and slidably engaged by sliding rolls (66) to a cam profile of the control means (64).

17. Feeding device of chocolates and similar products (100) for a wrapping machine characterized in that said feeding device includes:

a first belt means (13), which has a continuous advance motion, supports and moves a plurality of products (100), aligned and arranged in a single line at mutual contact;

a second belt means (14), aligned downstream from the first belt means (13), having an alternate advance motion and associated with holding means (15) for the product (100);

a positioning wheel (9) rotating, facing the second belt means (14) immediately downstream of the holding means (15) and having angularly equidistant a plurality of pliers means (11) for gripping the product (100);

the second belt means (14) moves the products (100), reciprocally spaced, from a picking condition (A), in which the second belt means (14) receives the product (100) from the first belt means (13), through moving conditions (M), in which the holding means (14) keep each product (100) fixed to the second belt means (14), to a transfer condition (T), in which the second belt means (14) is motionless and the product (100), not constrained thereto anymore, is grasped by a pliers means (11) of the positioning wheel (9), which moves the product (100) with circular motion, from the transfer condition (T) to a release condition (R) in which the wheel (9) is motionless and the pliers means (11) is opened for transferring the product (100) to the wrapping machine, the feeding device being totally controlled by electronic calculation and control means fit to control the phase relations at least among the belt means (13, 14, 16), the positioning wheel (9) and the pliers means (11).

* * * * *